United States Patent [19]

Crandall et al.

[11] 4,016,714

[45] Apr. 12, 1977

[54] STRING CONSTRUCTION

[75] Inventors: Julian Titsworth Crandall, Ashaway; Steven Julian Crandall, Quonochontaug, both of R.I.

[73] Assignee: Ashaway Line & Twine Mfg. Co., Ashaway, R.I.

[22] Filed: May 21, 1975

[21] Appl. No.: 579,612

[52] U.S. Cl. ..... 57/149; 57/153; 428/375; 428/377

[51] Int. Cl.[2] ..... D02G 3/36; D02G 3/38; D02G 3/44

[58] Field of Search ..... 57/140 C, 149, 153; 428/375, 377, 380

[56] References Cited

UNITED STATES PATENTS

| | | | |
|---|---|---|---|
| 2,401,291 | 5/1946 | Smith | 57/140 C |
| 3,605,399 | 9/1971 | Van Rijswijk | 57/149 |
| 3,738,096 | 6/1973 | Crandall | 57/140 C X |
| 3,745,756 | 7/1973 | Crandall | 57/149 |
| 3,755,165 | 8/1973 | Bhakuni et al. | 57/153 X |
| 3,771,305 | 11/1973 | Barnett | 57/140 C X |

*Primary Examiner*—Richard C. Queisser
*Assistant Examiner*—Charles Gorenstein
*Attorney, Agent, or Firm*—Salter & Michaelson

[57] ABSTRACT

A string construction for athletic rackets, musical instruments and the like, comprising a thermoplastic core coated with a cationic lubricating agent, and a second coating comprising a thermoplastic resin surrounding and bonded to said first coating.

9 Claims, 9 Drawing Figures

STRING CONSTRUCTION

BACKGROUND AND SUMMARY OF THE INVENTION

In the manufacture of tennis strings, or strings for other athletic rackets, such as badminton, squash and the like, as well as strings for musical instruments, it is important that the string have the proper combination of elongation (modulus of elasticity) and resiliency (internal damping). A string having too high a modulus of elasticity will not elongate acceptably and hence will not give the desired results; while, by the same token, a string which has high internal damping will not exhibit sufficient resiliency to give the desired results.

It is well known in the manufacture of such strings to provide a core or filler which may comprise a plurality of thermoplastic strands twisted or otherwise bundled together and then integrating said core or filler by coating same with a thermoplastic formulation. In some cases, the integrated core or filler is then provided with some kind of a wrap or sheath thereover, after which the wrapped core is again integrated by coating same with said thermoplastic formulation. Applicant's prior U.S. Pat. No. 2,649,833; 2,712,263; and 3,745,756 are illustrative of tennis strings so manufactured.

It has now been found that the integration of the above described type of string by the aforesaid thermoplastic formulation locks the string, and particularly the core or filler thereof, so tightly together that elongation of the string appears to be decreased and internal damping (energy lost to friction on impact) increased, both of which are undesirable. It has been found, however, that by coating the core or filler with a lubricating agent before applying the thermoplastic formulation to the string, the core or filler is capable of some degree of movement when the string is set into vibration upon contact thus permitting more effective elongation of the string and, at the same time, enhanced resiliency, since there is less dissipation or loss of energy due to friction. The problem, however, has been to find a lubricating agent, or class of lubricating agents, which will permit these desired objectives to be achieved, but which at the same time may be effectively bonded to the thermoplastic formulation which is subsequently applied to the string. In this connection, it has been found that cationic lubricating agents permit the desired bonding to take place with the thermoplastic formulation, while at the same time permitting the desired movement of the core or filler, and its constituent fibers, thereby permitting an optimum degree of resiliency of the filler elements to be achieved.

Other objects, features and advantages of the invention will become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
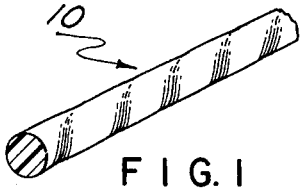
FIG. 1 is a perspective view of one of the individual strands which may be used to form the core of the string.
Figure 2:
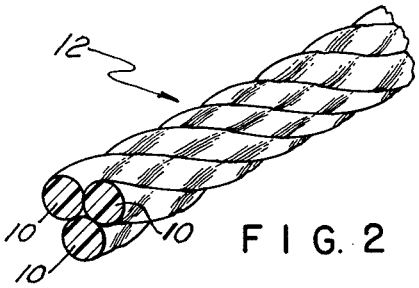
FIG. 2 illustrates a plurality of the strands shown in FIG. 1 twisted together.

Referring now to the drawings, and more particularly to FIGS. 1 and 2 thereof, there is shown at 10 a single end or strand of thermoplastic, used in forming the core or filler for the string to be manufactured. The strand 10 may be of nylon, polyester, such as DACRON (duPont trademark), fiberglass, or aramid fibers, such as KEVLAR or NOMEX (both duPont trademarks). FIG. 2 shows a core or filler 12 which has been formed by twisting together three of the strands 10. Although it is not absolutely essential, it may be desirable to impart a gentle twist to the strands 10 in a first hand which is opposite to the direction of twist utilized when twisting the strands 10 together to form the core or filler 12. It should also be noted that the core 12 need not necessarily comprise three twisted ends, but rather more or less ends could be used when forming the core, it being apparent that the denier of the strands 10 will be dependent on how many strands are employed when forming the core. Also, it is within the scope of this invention to form the core 12 by braiding a plurality of ends together, rather than by twisting said ends together, as per FIG. 2.

The real novelty in the present invention resides in the coating of the core 12 with a cationic lubricating agent. Examples of such agents are METHACROL LUBRICANT K (duPont trademark) which is an oil-based cationic emulsion and, specifically, is a mineral-oil type of product that is emulsified in water, specifically, a 30 percent aqueous dispersion. Another cationic lubricating agent that has been found effective is ZELEC DP (duPont trademark) which is a dispersion of a cationic polymer which is partially neutralized by an anionic surfactant. Actually, ZELEC DP also has antistatic characteristics, but it is not thought that these specific characteristics are important to the present invention.

Still another cationic lubricating agent which is effective in carrying out the present invention is AVITEX NA (duPont trademark), which is a quaternized alkylamine ester. AVITEX NA, like ZELEC DP, also has antistatic characteristics, in addition to functioning as a lubricant.

The coating of the core 12 with the cationic lubricating agent may be effected by coating the individual strands 10 before they are combined to form the core 12, or by coating the core 12 after the individual strands have been combined, or both. The important thing is that the core 12 and the strands which make it up be completely coated with the lubricating agent before any subsequent steps are performed, and specifically before the core 12 is coated with the thermoplastic formulation hereinafter to be described. The physical means for coating the strands 10 and/or the core 12 with the cationic lubricating agent may comprise any suitable mechanisms and/or techniques; and in FIG. 3 there is shown, by way of example, an arrangement whereby the core 12 is fed over roller 14 and then down into tank 16 having the cationic lubricating agent 18 therein, said core passing beneath roller 20 and then upwardly over roller 22 from where it passes through an elongated heating chamber 24 where the coating is dried. It will be understood, of course, that if the strands 10 are coated prior to being twisted together, then the strands 10 will be coated in the precise manner illustrated in FIG. 3.

Figure 3:
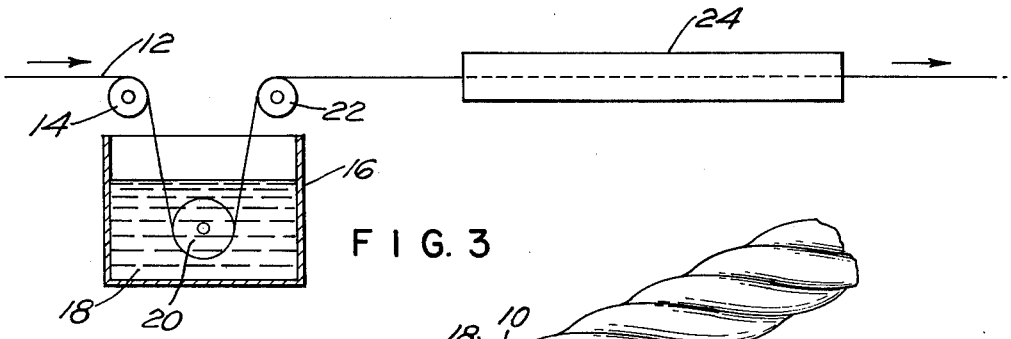
FIG. 3 schematically illustrates the coating and drying means used in the instant invention.
Figure 4:
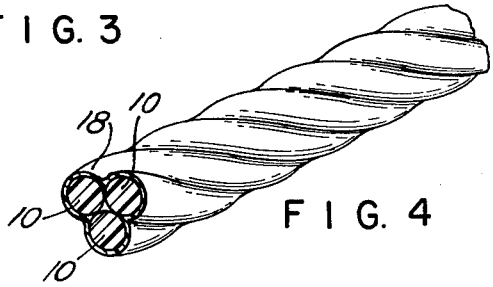
FIG. 4 is a fragmentary perspective view, on an enlarged scale, showing the core of FIG. 2 after it has been coated with the lubricating agent.
Figure 5:
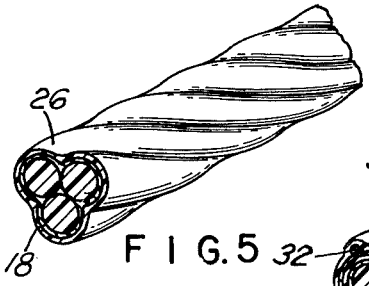
FIG. 5 shows the core of FIG. 4 after it has been coated with the thermoplastic formulation.
Figure 9:
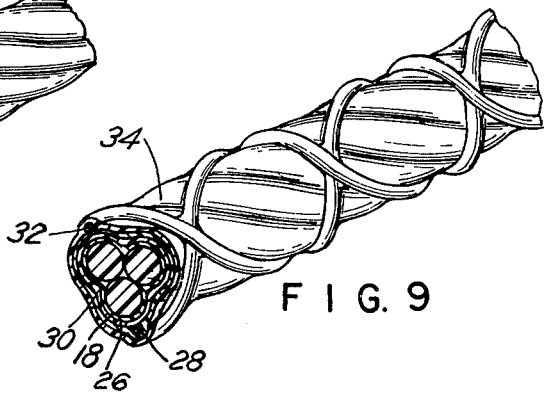
FIG. 9 shows the string of FIG. 8 with the final plastic coating applied thereto.

After the core 12 has been coated with the cationic lubricating agent 18, as illustrated in FIG. 4, the next step is to pass the string through a thermoplastic formulation, preferably comprising a nylon solution having by weight approximately 14.4 percent nylon; 61.1 percent methanol; 4.9 percent tetrahydrofurfyl alcohol; and 19.6 percent water. The above proportions are not critical but have been found to be desirable for providing a nylon solution of suitable consistency. It will be understood that the same apparatus as shown in FIG. 3 may be utilized for applying the thermoplastic formulation, shown at 26 in FIG. 5, to the string, although it has been found that somewhat more heat is required to effectively dry the cationic lubricating agent than is required to effectively dry the nylon formulation, and hence the rate at which the string passes through the heating chamber is somewhat slower where the lubricating agent is being dried and the chamber is maintained at a higher temperature. It has been found that a number of passes of the string through the nylon formulation and the heating chamber is desirable in order to completely and effectively coat the string with the nylon.

Figure 6:
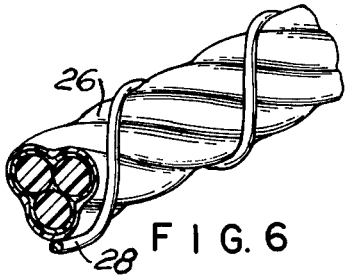
FIG. 6 shows the string of FIG. 5 with a spiral wrap formed thereover.
Figure 7:
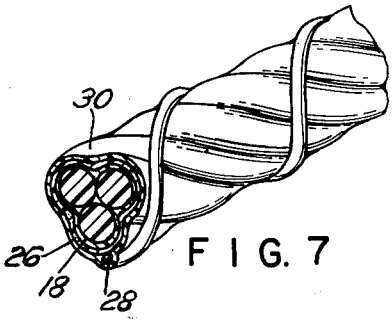
FIG. 7 shows the string of FIG. 6 after it has once again been coated with the plastic formulation.
Figure 8:
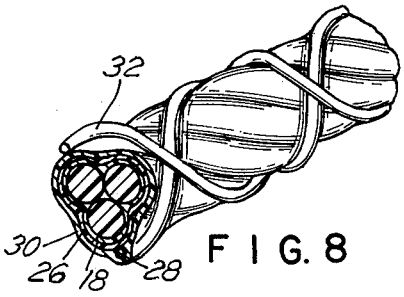
FIG. 8 shows the string of FIG. 7 with a second spiral wrap, in opposite hand, provided thereover.

In order to build up and strengthen the string, it may be desirable to provide an outer wrap over the coated string; and, for example, a spaced spiral wrap of nylon monofilament 28 may be provided thereover, as shown in FIG. 6. This is similar to the wrap shown in aforesaid U.S. Pat. No. 3,745,756, and it is preferred that the direction of the wrap 28 be opposite to the direction of twist of core 12. It will be understood, however, that other forms of wrap or even braid may be utilized in place of the spiral wrap 28, examples of such other wraps or braids being shown in applicant's prior U.S. Pat No. 2,649,833; 2,712,263; 2,735,258; and 2,861,417. After the wrap 28 has been applied, the resultant string is again passed through the aforesaid nylon formulation and associated heating chamber a number of times to provide an outer coating 30 over the wrap. Where a spaced spiral wrap 28 is employed, it then may be desirable to provide a further spiral wrap of nylon monofilament 32 in opposite hand to that of wrap 28, as illustrated in FIG. 8; and then once again the string is passed through the nylon formulation and heating chamber a number of times to provide an outer nylon coating 34 over the composite string.

As previously stated, the key feature of the present invention is the application of the cationic lubricating agent to the core 12, and it has specifically been found that the use of a cationic lubricating agent is important, because this lubricating agent will form a bond or effectively unite with the subsequent nylon formulation that is applied to the string. If such a bond is not effectively made, then the string will not integrate, but rather will peel apart and not be satisfactory. At the same time, the presence of the cationic lubricating agent permits some degree of movement or shifting to take place in the core of the string or the filamentary components thereof, when the string strikes a ball or is otherwise set into vibration. This movement or shifting seems to result in improved internal damping in the string, whereby less energy is lost on impact and greater resiliency is achieved.

The following are some specific examples illustrating applicants' invention.

EXAMPLE 1

A plurality of ends of 840 denier nylon were twisted together at 1½ turns per inch Z. The resultant string was then passed through a formulation comprising the following:

| | |
|---|---|
| duPont Zelec ZP | 20% |
| duPont Methacrol Lubricant | 10% |
| Balance water | 70% |

After the string was passed through the above lubricant formulation, it was passed a number of times through a 50-foot long heating tower in order to achieve proper drying. The string was then passed through a nylon formulation comprising:

| | |
|---|---|
| Nylon resin | 14.4% |
| Methanol | 61.1% |
| Tetrahydrofurfyl alcohol | 4.9% |
| Water | 19.6% |

The coated string was then passed a number of times through a 50-foot long heating tower to achieve proper drying of the nylon formulation. This entire coating and drying process was repeated several times. One end of 150-denier nylon monofilament was then applied in an S-wrap around the coated string by using a 16-carrier braider. The wrapped string was then passed through the aforesaid nylon formulation and heating tower several more times, and then a second Z-wrap of 150-denier monofilament nylon was applied by using a 16-carrier braider. The wrapped string was then passed through the aforesaid nylon formulation and associated heating tower several more times, and then the coated string was heat stretched to allow proper filament orientation. The stretched string was then pased through the nylon formulation and associated heating tower a substantial number of times to achieve a smooth, resistant finish.

EXAMPLE 2

Three separate ends of 1500-denier KEVLAR were each twisted a number of turns S. The three twisted ends of KEVLAR were then twisted together a number of turns Z to give a 1 × 3 filler or core. The twisted core or filler was then passed once through the lubricant solution as described in Example 1 supra and through the associated heating tower, also as described in Example 1. The lubricant-coated filler or core was then given a number of passes through the nylon resin solution and associated heating tower, as described in Example 1 supra. The coated string was then wrapped in an S direction with a single end of 200-denier nylon monofilament using a 16-carrier braider. The wrapped string was then given a substantial number of finishing passes through the nylon resin solution and associated heating tower, as aforesaid.

EXAMPLE 3

A single end of 200-denier KEVLAR was passed once through the aforesaid lubricant solution and associated heating tower and then was put onto braider bobbins. A 16-carrier braider was then used to braid the lubricant-coated KEVLAR to form a braided core or filler. The braided core or filler was then given one pass through the aforesaid lubricant solution and associated drying tower. The braided filler was then given a number of passes through the aforesaid nylon resin solution and associated drying tower, after which the filler was wrapped S on a 16-carrier braider using 150-denier nylon monofilament. The wrapped string was then coated by passing it through the aforesaid nylon resin solution and associated drying tower a number of times. A second wrap Z was then applied on a 16-carrier braider using 150-denier nylon monofilament. The wrapped string was then given a substantial number of passes through the aforesaid nylon resin solution and associated drying tower to achieve a smooth, resistant finish.

All of the above strings were tested and were found to possess effective elongation and resiliency characteristics, and particularly appeared to exhibit improved internal damping when set into vibration than similar strings which were not coated with the cationic lubricating agent prior to being coated with the nylon formulation.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A string construction comprising as it essential ingredients a thermoplastic core, a first coating on said core consisting of a cured cationic lubricating agent, and a second coating comprising a thermoplastic resin surrounding and bonded to said first coating.

2. In the string of claim 1, said core consisting of one of the following thermoplastic materials: nylon, polyester, fiberglass or aramid fibers.

3. In the string of claim 1, said thermoplastic resin comprising a nylon formulation.

4. In the string of claim 1, said core comprising a plurality of individual ends twisted together.

5. In the string of claim 1, said core comprising a plurality of individual ends braided together.

6. In the string of claim 1, an armor sheath of thermoplastic surrounding said second coating, and a further coating of said thermoplastic resin surrounding said armor sheath and integrated with said sheath and said second coating.

7. In the string of claim 6, said armor sheath comprising a braid.

8. In the string of claim 6, said armor sheath comprising a spiral wrap;

9. In the string of claim 1, said core comprising a plurality of individual ends twisted together, said ends consisting of one of the following: nylon, polyester, fiberglass or aramid fibers, said thermoplastic resin comprising a nylon formulation, and a thermoplastic armor sheath consisting essentially of nylon surrounding said second coating, and a further coating of said thermoplastic resin surrounding said armor sheath and integrated with said sheath and said second coating.

* * * * *